US006141928A

United States Patent [19]

Platt

[11] Patent Number: 6,141,928

[45] Date of Patent: Nov. 7, 2000

[54] POST MOUNT

[76] Inventor: Robert E. Platt, 8701 Highland Ave., Mineral Ridge, Ohio 44440

[21] Appl. No.: 09/246,350

[22] Filed: Feb. 8, 1999

[51] Int. Cl.[7] ..... E02D 27/42

[52] U.S. Cl. ..... 52/296; 52/301; 52/720.2; 256/65

[58] Field of Search ..... 52/296, 301, 298, 52/720.2, 40; 256/65

[56] References Cited

U.S. PATENT DOCUMENTS

| | | | |
|---|---|---|---|
| 3,241,279 | 3/1966 | Bailey | 52/296 |
| 3,256,659 | 6/1966 | Dudoff | 52/298 |
| 3,349,531 | 10/1967 | Watson | 52/296 |
| 4,104,000 | 8/1978 | Fleischmann | 256/65 X |
| 4,603,526 | 8/1986 | Bollmann | 52/296 |
| 4,662,139 | 5/1987 | Bollmann | 52/296 |
| 4,793,111 | 12/1988 | Shewchuk | 52/296 X |
| 4,809,955 | 3/1989 | Veilleux | 256/65 |
| 5,499,885 | 3/1996 | Chapman | 52/296 X |

*Primary Examiner*—Beth A. Stephan
*Assistant Examiner*—Brian E. Glessner
*Attorney, Agent, or Firm*—Sand & Sebolt

[57] ABSTRACT

A post mount for affixing a construction member having a cavity to a floor includes a support block, an adjustment plate, a plurality of adjustment bolts threadably mounted to the adjustment plate, a bearing plate, a plurality of optional compression pins, a clamping plate, a bolt extending therethrough, and a nut connected to the bolt. The support block is fixedly attached to the floor and is slidingly received in the cavity. The post mount securely affixes the post to the floor and permits the post to be oriented plumb with the vertical direction and provides support to allow the post to withstand moderate shock loading to the lower end thereof. A second embodiment of the present invention is attached to a floor that has an inaccessible underside, such as a concrete floor. The second embodiment does not utilize compression pins or a clamping plate, and instead uses a threaded insert disposed within the floor, the bolt cooperating threadably with the threaded insert to secure the post mount against the floor. A third embodiment of the present invention additionally includes a sleeve that fits between the support block and the cavity and can extend the length of the post.

35 Claims, 11 Drawing Sheets

| |
|---|
| FIG-2C |
| FIG-2B |
| FIG-2A |

POST MOUNT

BACKGROUND OF THE INVENTION

1. Technical Field

The invention relates generally to a support for a post and, more particularly, to a support that resists shock loading to the post and that permits the post to be aligned plumb with the vertical direction. Specifically, the invention relates to a support that is adjustably mounted to a floor and is slidingly received in a cavity formed in a post, the support being adjustable to orient the post plumb with the vertical direction and permitting the post to withstand shock loading at the lower end thereof.

2. Background Information

Fences and railings are used in numerous building applications for diverse purposes, the most typical being to provide a barrier adjacent the edge of an elevated floor structure such as a porch, a balcony, or a recreational deck. Such fences often contain a plurality of posts affixed to and extending upwardly from the floor with stringers and balusters connecting the posts with one another to form a continuous structure around the exposed circumference of the floor. The attachment of each of the posts to the floor and the consecutive connection of the posts with one another provide a relatively strong barrier that protects a person from inadvertently falling off the edge of the floor.

Numerous materials are used for making such fences—including wood, metal, and polyvinyl chloride (PVC), among other materials. Among the most popular fences have been those constructed of hollow sections of PVC due to advantages in cost, workability, weight, versatility, and longevity, as well as other relevant factors. The use of such PVC fences has not, however, been without limitation.

Hollow PVC posts have heretofore been difficult to securely attach to the floor inasmuch as the PVC itself typically does not provide a solid anchor for threaded fasteners such as screws and bolts that are typically used to attach a post to the floor. It is also known that PVC posts provide insufficient resistence to impact loading at the lower end where the post is connected to the floor and where the post is subject to accidental bumping and kicking by persons standing on the floor. Moreover, fences and railings are most structurally sound and most aesthetically pleasing when the posts are oriented plumb with the vertical direction, and hollow PVC posts have proven to be difficult to fixedly attach to a floor in a direction plumb with the vertical inasmuch as the walls of the post are relatively thin and not suited to accept threaded fasteners therein. A need thus exists for a post mount that securely attaches a hollow PVC post to a floor, permits the post to be oriented plumb with the vertical direction, and provides sufficient strength to allow the post to withstand moderate shock loading at its lower end.

SUMMARY OF THE INVENTION

In view of the foregoing, an objective of the present invention is to provide a post mount that securely mounts a hollow construction member, such as a post, to a floor.

Another objective of the present invention is to provide a post mount that adjustably orients a construction member plumb with the vertical direction.

Another objective of the present invention is to provide a post mount that enhances the structural integrity of a hollow construction member mounted to a floor and that permits the post to withstand moderate shock loading at the lower end thereof.

Another objective of the present invention is to provide a post mount that can be used to attach a hollow construction member to a variety of different types of floors.

Another objective of the present invention is to provide a post mount that securely attaches a construction member to a floor and prevents movement of the post relative to the floor.

Another objective of the present invention is to provide a post mount that mounts a construction member to a floor with little or no protrusion of fasteners from the external surface of the construction member.

Another objective of the present invention is to provide a post mount that securely mounts a construction member to a surface that is other than perfectly planar.

Another objective of the present invention is to provide a post mount that mounts existing posts to floors.

These and other objectives are achieved by the post mount of the present invention, the general nature of which can be stated as including a floor, a post mount mounted on the floor, and a construction member having a cavity in a first end, the post mount being slidably received in the cavity.

These and other objectives are achieved by the post mount of the present invention, the general nature of which can be stated as including a support block having a support surface, the support surface configured to be slidingly received in the cavity, and a bolt passing through at least a portion of the support block, the bolt adapted to be engagable with the surface to connect the support block to the surface.

BRIEF DESCRIPTION OF THE DRAWINGS

The preferred embodiments of the invention, illustrative of the best modes in which applicant contemplated applying the principles of the invention, are set forth in the following description and are shown in the drawings and are particularly and distinctly pointed out and set forth in the appended claims.

FIG. 2A is an exploded view of a portion of the first embodiment;

FIG. 2B is an exploded view of a portion of the first embodiment;

FIG. 2C is an exploded view of the post used in conjunction with the first embodiment;

Similar numerals refer to similar parts throughout the specification.

DESCRIPTION OF THE PREFERRED EMBODIMENTS

Figures 1, 2:
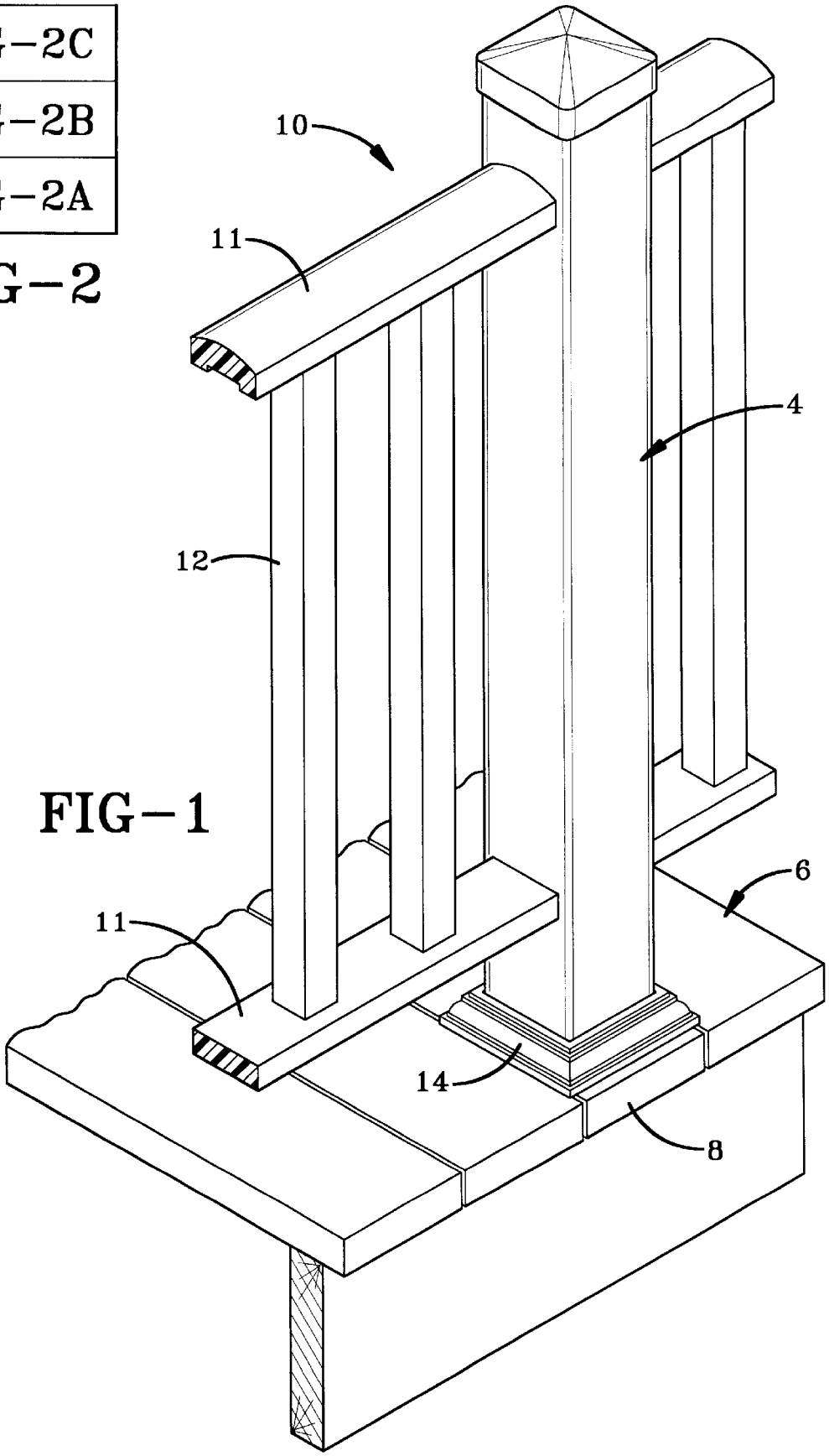
FIG. 1 is a perspective view of a fence that incorporates the post mount of the present invention.
FIG. 2 comprising
Figure 2A:
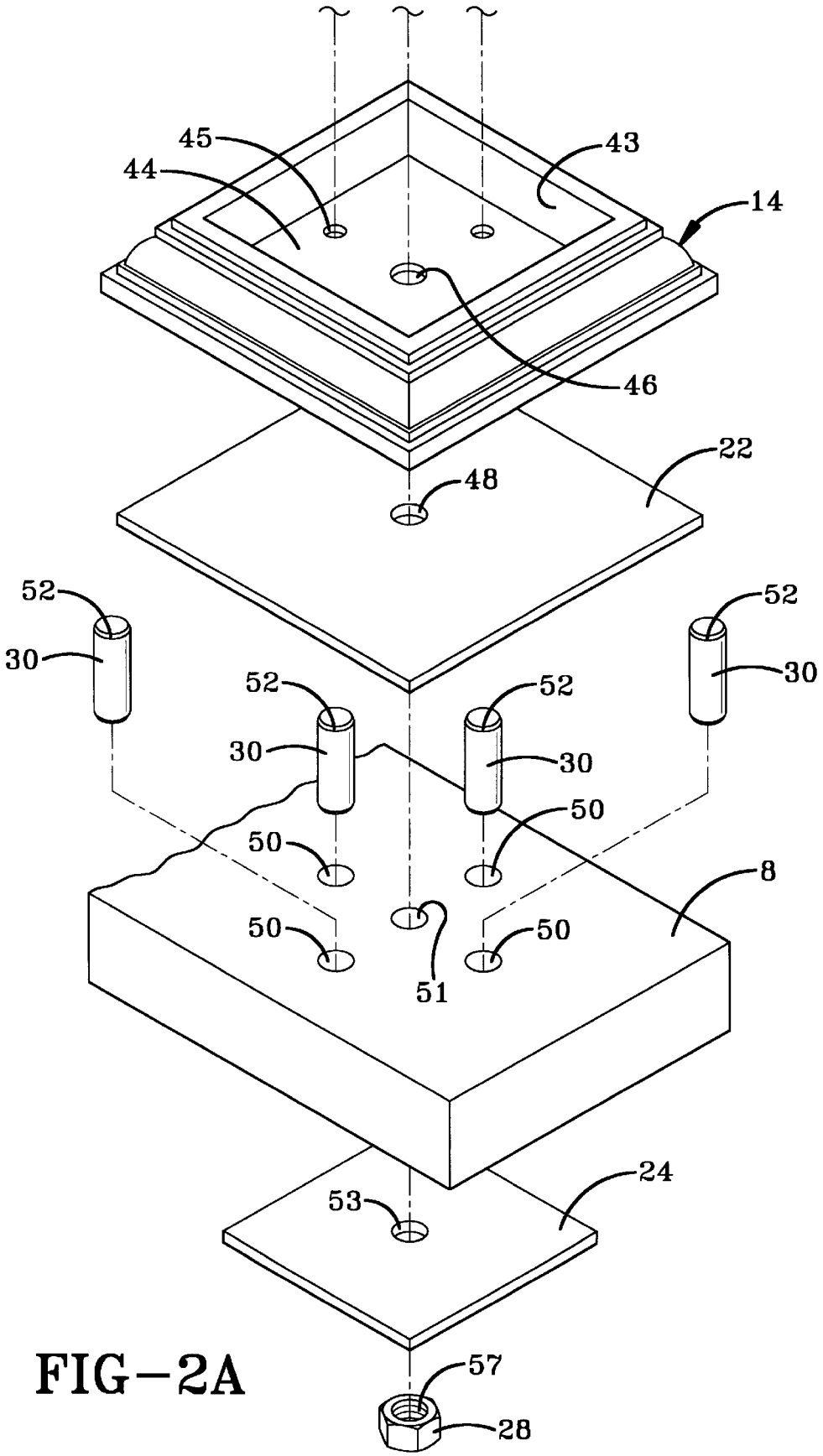
FIGS. 2A, 2B, and 2C, is an exploded view of a first embodiment of the post mount of the present invention.
Figure 2B:
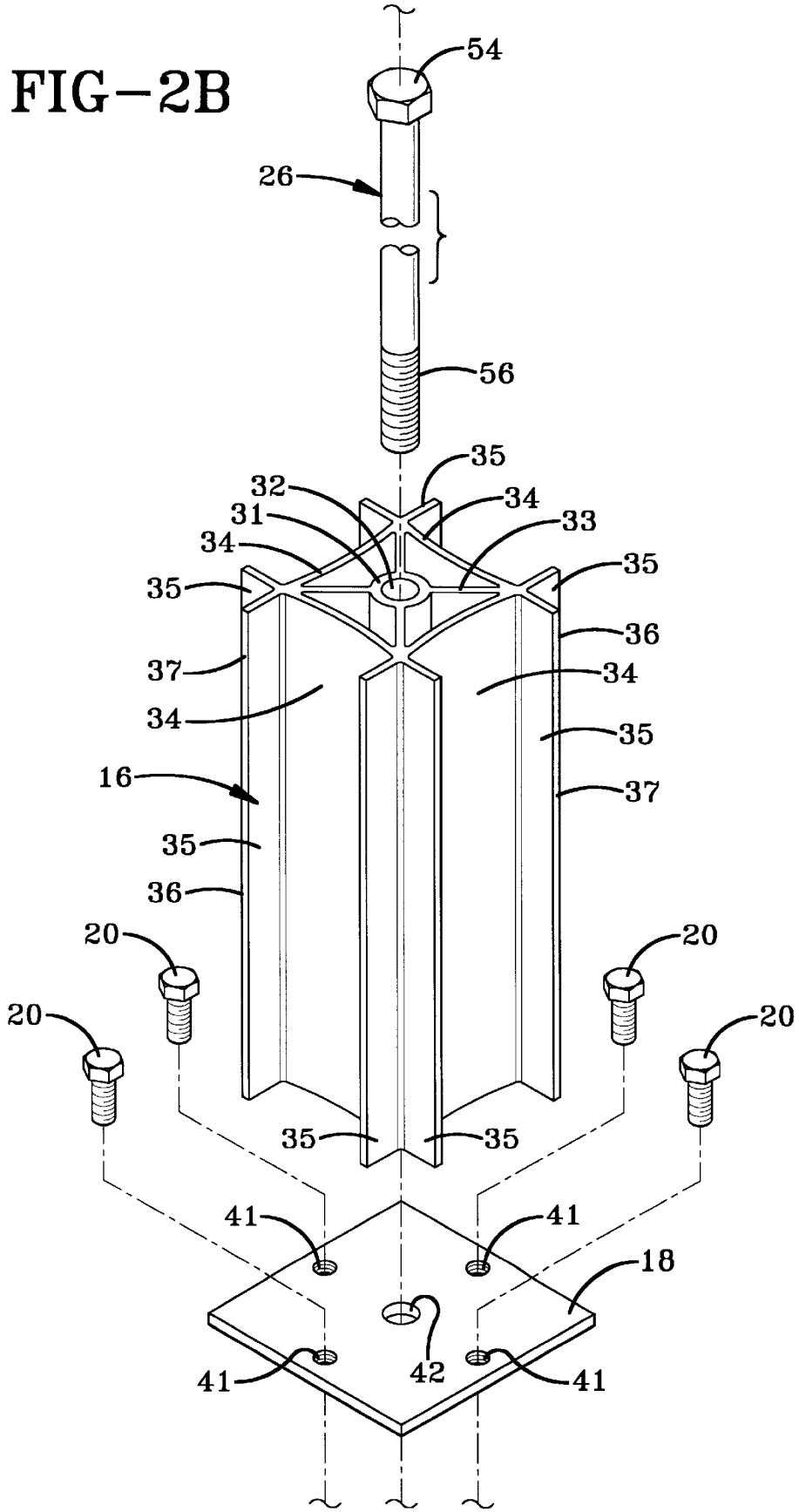
Figure 2C:
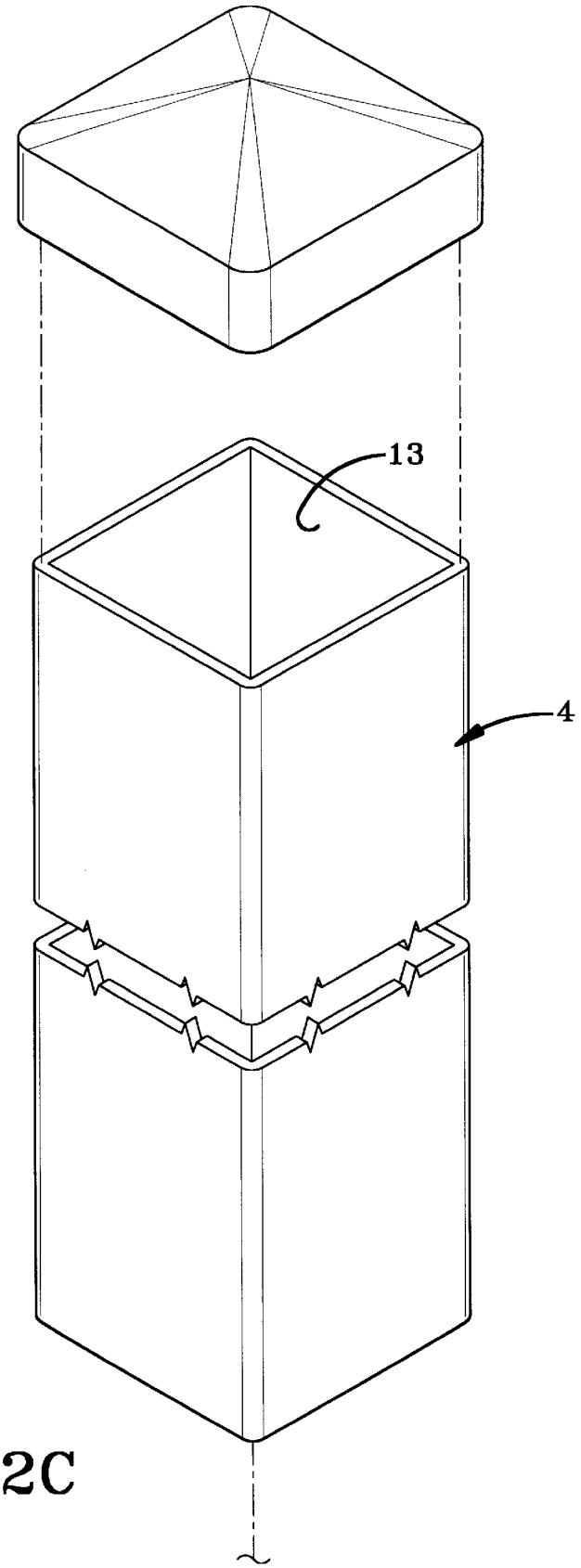
Figure 3:
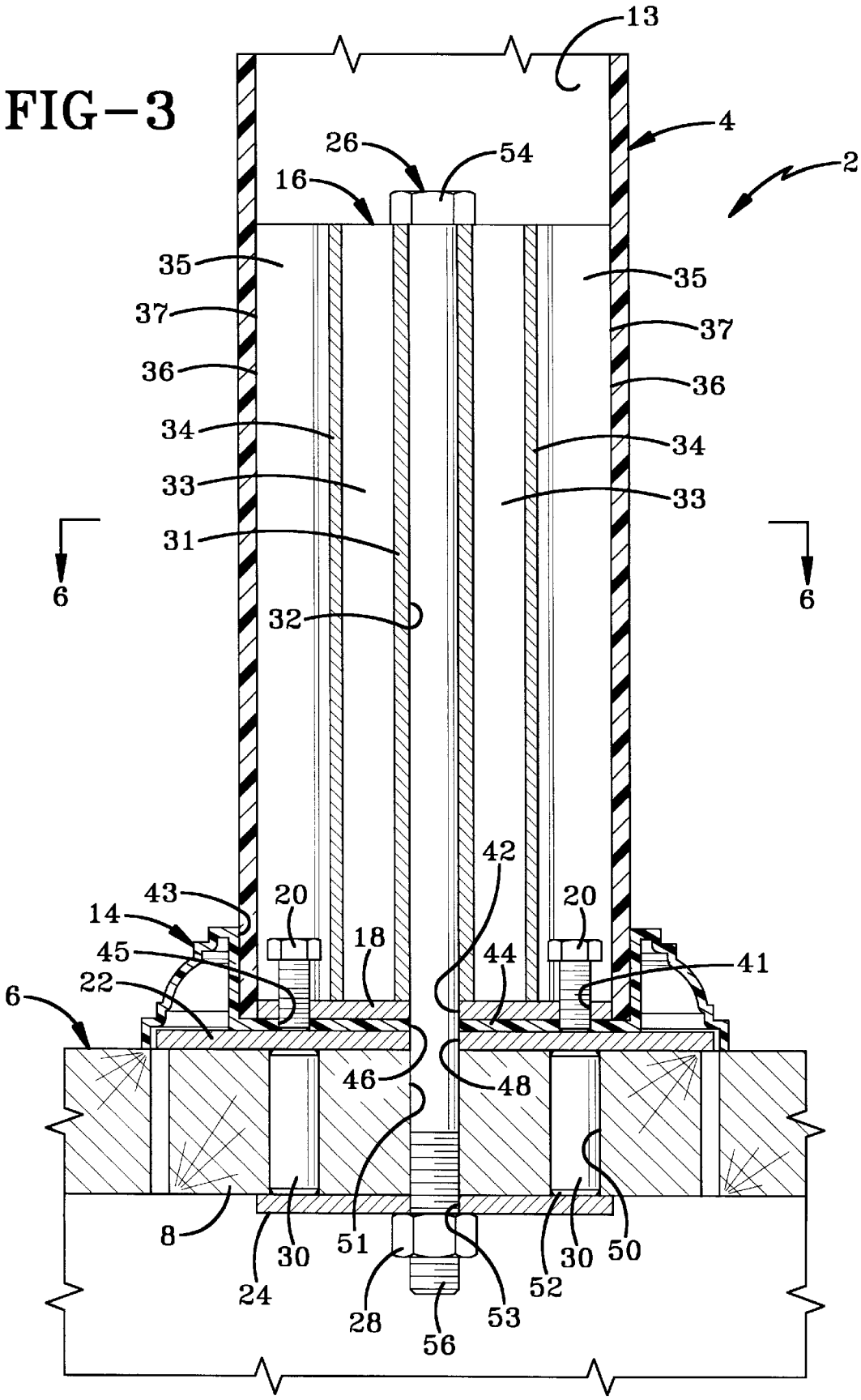
FIG. 3 is a longitudinal sectional view of the first embodiment.

A first embodiment of the post mount of the present invention is indicated generally by the numeral 2 in FIGS. 1–4. Post mount 2 is used to affix a construction member such as a post 4 to a floor 6. In the event that floor 6 is constructed of wood planking, it is preferred that post mount 2 be centered over a single plank 8 instead of spanning multiple planks. Nevertheless, post mount 2 may be installed such that it spans several planks without departing from the spirit of the present invention.

Post 4 is a construction member that is a structural component of a fence 10 that is attached to floor 6. As is known in the art, fence 10 includes one or more posts 4 attached to floor 6 with a pair of stringers 11 attached between posts 4, one stringer 11 at an upper end of post 4 and the other stringer 11 at the lower end thereof. One or more balusters 12 often extend between stringers 11. The specific configuration stringers 11 and balusters 12 depends upon the particular needs of the application and the desired aesthetic characteristics to be achieved.

Post 4 is formed with a cavity 13 at least at the lower end thereof. In the preferred embodiments, cavity 13 extends longitudinally through the length of post 4 to render post 4 a hollow member, but it is understood that post 4 could be solid except for cavity 13 at a lower end thereof without departing from the spirit of the present invention. Post 4 additionally includes a base molding 14 that extends around the circumference of post 4 at its point of connection with floor 6. Base molding 14 provides an aesthetic transition between post 4 and floor 6 and additionally can cover portions of post mount 2 that may protrude from underneath or from the lower end of post 4. Base molding 14 can, however, be omitted without departing from the spirit of the present invention.

Post mount 2 includes a support block 16, an adjustment plate 18 including a plurality of adjustment bolts 20, a bearing plate 22, a clamping plate 24, a bolt 26, a nut 28, and a plurality of compression pins 30. Support block 16 is an elongated member having a body formed at least partially by a center lug 31 having a cylindrical center hole 32 extending therethrough. Center lug 31 may be circular as depicted in the drawings or a variety of other shapes that provide support around center hole 32. The body of block 16 further includes a plurality of first webs 33 extending outwardly from center lug 31, with first webs 33 being interconnected with a plurality of second webs 34 extending therebetween. In the embodiment of the invention depicted in the drawings, first webs 33 are substantially radially disposed with respect to center hole 32 and may be referred to as radial webs. Second webs 34 connect first webs 33 and may be referred to as transverse webs. A plurality of fins 35 extend outwardly from the confluence of adjacent second webs 34, with each fin 35 terminating at a tip 36. A support surface 37 of the body of block 16 includes of each tip 36 that slidingly engages post 4.

The specific configuration of support block 16 provides strength and permits support block 16 to resist bending and twisting forces. Support block 16 may be readily manufactured by extrusion processes known and understood in the art, with support block 16 being manufactured out of a readily extrudable material such as aluminum, PVC, vinyl, or other such appropriate material. Other methods may be used to manufacture support block 16 without departing from the spirit of the present invention. While in the preferred embodiments support block 16 is an elongated extruded body having the specific configuration of center lug 31, radial webs 33, transverse webs 34, and fins 35, it is understood that support block 16 may be manufactured out of an elongated block of an appropriate material such as wood or PVC or other such material formed with center hole 34 and configured with support surface 37 without departing from the spirit of the present invention.

Figure 10:
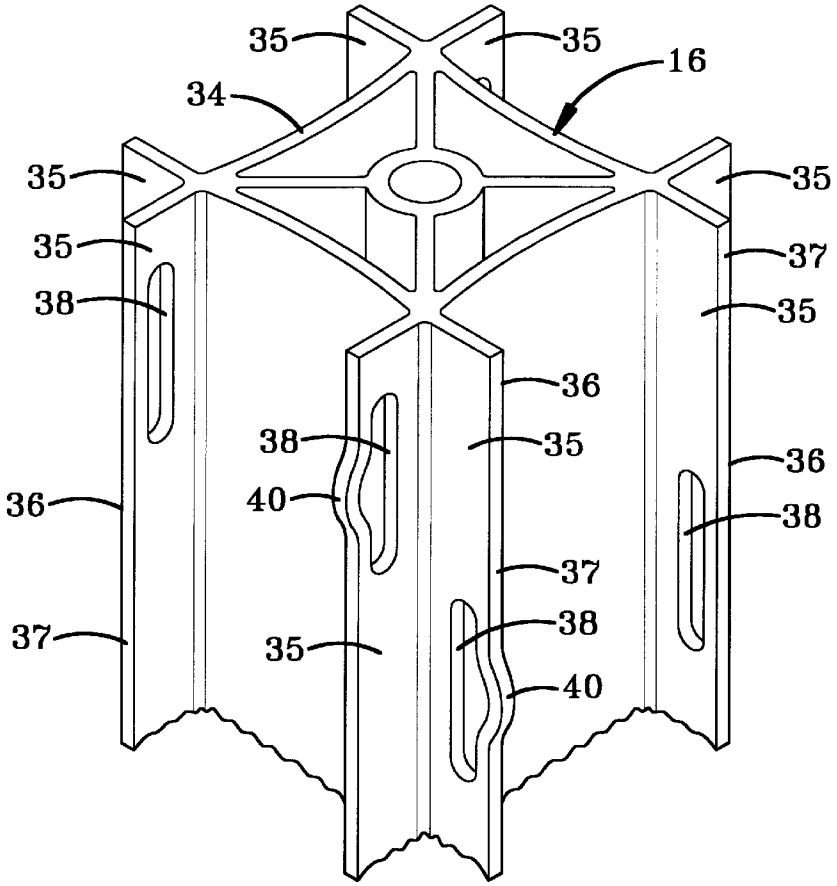
FIG. 10 is another alternate configuration of the support block of the present invention.
Figure 9:
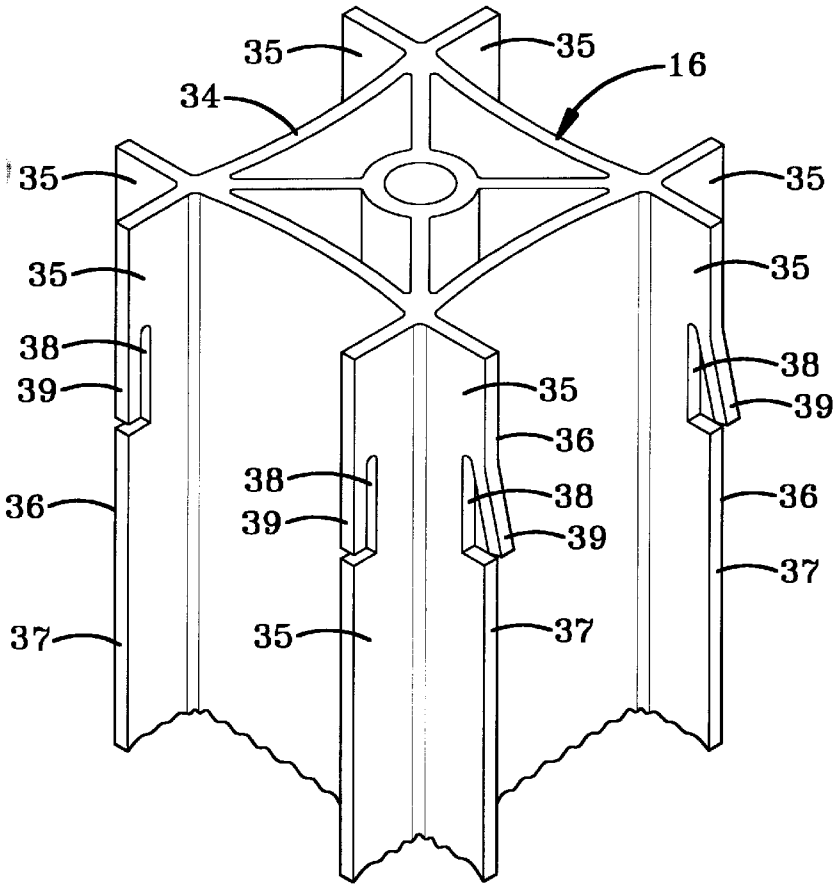
FIG. 9 is a perspective view of an alternate configuration of the support block of the present invention.

In the preferred embodiments of the present invention, fins 35 are each preferably formed with a cut 38 at the ends thereof to define a deflection member. As can be seen in FIG. 9, notch 38 may be of an L-shaped configuration to define a deflection member in the form of a lip 39 on fin 35 that is deflected outwardly to engage the inner surface of construction member or post 4 when support block 16 is slidingly received in cavity 13. Alternatively, as can be seen in FIG. 10, cut 38 may be of an ellipsoidal, ovaline, or other elongated configuration that cuts a hole in fins 35 to define a deflection member in the form of a tab 40 that is deflected outwardly with an appropriate tool (not shown) to engage the inner surface of construction member or post 4 when support block 16 is slidingly received in cavity 13. Inasmuch as the sizes of support block 16 and post 4 can vary with the prevailing thermal ambient and atmospheric conditions and with differing production runs, lips 39 and tabs 40 provide an additional structure for tightly affixing post 4 to post mount 2. Lips 39 or tabs 40 may be provided at the top or bottom of support block 16 or may be provided at both the top and bottom. Lips 39 or tabs 40 may also be formed along the entire length of fins 35. Although lips 39 and tabs 40 may be desired features of support block 16, they are not required for support block 16 to properly function.

Lips 39 and tabs 40 are biased to the outward position indicated in FIGS. 9 and 10 prior to installation of post 4 thereon. Inasmuch as lips 39 and tabs 40 are forced inwardly when support block 16 is received within cavity 13, lips 39 and tabs 40 provide a force in the outward direction against post 4 after post 4 had been installed thereon. Lips 39 and tabs 40 thus provide a residual holding force against cavity 13 that remains despite temperature changes and other such conditions that might otherwise tend to loosen the fit between support block 16 and cavity 13. It is understood, however, that support block 16 can be used without lips 39 or tabs 40 formed thereon. When lips 39 or tabs 40 are formed in fins 35, support surface 37 also includes the outermost edges of lips 39 or tabs 40 that contact post 4.

Adjustment plate 18 is a plate having a perimeter that corresponds with support surface 37 of support block 16. Adjustment plate 18 has a plurality of threaded holes 41 located at approximately the midpoint of each side. Threaded holes 41 cooperate threadably with adjustment bolts 20 to permit adjustment plate 18 to be selectively adjusted with respect to floor 6 by the selective rotation of adjustment bolts 20. Inasmuch as support bock 16 is compressively held against adjustment plate 18, as will be set forth more fully below, adjustment plate 18 is manufactured of a material appropriate to withstand the stresses typically experienced with such compression, such as steel or other such appropriate material, and is of a corresponding thickness appropriate to withstand such stresses. Adjustment plate 18 is additionally formed with a bolt hole 42 centrally disposed therein and sized to accommodate bolt 26 therethrough with substantially no resistance. Bolt 42 is aligned with the center hole 32 when adjustment plate 18 is in its proper position.

Base molding 14 is a trim member formed with an opening 43 sized and shaped to slidably receive a portion of post 4 therein. Opening 43 terminates at a retention plate 44 at a lower end thereof. Retention plate 44 has a plurality of molding holes 45 that align with threaded holes 41 of adjustment plate 18. Molding holes 45 are sized to accommodate adjustment bolts 20 therethrough with substantially no contact or substantially no resistance. Retention plate 44 is additionally formed with a bolt hole 46 that aligns with holes 46 and 32 and is sized to accommodate bolt 26 therethrough with substantially no resistance. Base molding 14 is, in the preferred embodiments, manufactured of a material similar to or compatible with the material used to manufacture post 4, although other materials may be used without departing from the spirit of the present invention.

Bearing plate 22 is a plate that preferably has external dimensions at least nominally greater than those of adjustment plate 18 but less than those of base molding 14 to permit base molding 14 to cover bearing plate 22. Inasmuch as bearing plate 22 is compressed between adjustment bolts 20 and plank 8, as will be set forth more fully below, bearing plate 22 is manufactured of a material appropriate to withstand the bearing force imparted by adjustment bolts 20 such as steel, although other materials may be used without departing from the spirit of the present invention. Bearing plate 22 is formed with a bolt hole 48 that aligns with holes 46 and 32 and is sized to accommodate bolt 26 therethrough with substantially no resistance.

Plank 8 is drilled or otherwise formed to include a plurality of pin holes 50 sized to accommodate compression pins 30 therein. It is preferred that pin holes 50 be configured to provide a nominal interference fit with compression pins 30 to facilitate assembly of post mount 2 by permitting compression pins 30 to be easily inserted into pin holes 50 while preventing compression pins 30 from falling out of pin holes 50 at the underside thereof. Plank 8 is additionally drilled or otherwise formed to have a bolt hole 51 that aligns with hole 32 and is sized to accommodate bolt 26 therein with substantially no resistence.

Compression pins 30 are elongated cylindrical members that are suited to withstand the compression between bearing plate 22 and clamping plate 24, as will be set forth more fully below. Compression pins 30 are thus manufactured of a material such as steel, although other appropriate materials may be used without departing from the spirit of the present invention. The ends of compression pins 30 may have a bevel 52 to facilitate their insertion into pin holes 50, although compression pins 30 may have non-beveled ends without departing from the spirit of the present invention.

Clamping plate 24 is a substantially rectangular plate corresponding roughly to the size of adjustment plate 18 and formed with a bolt hole 53 that aligns with hole 51 and accommodates bolt 26. Clamping plate 24 is manufactured of a material suited to withstand the forces that may be imparted by bolt 26 such as steel or other appropriate material and is of a correspondingly appropriate thickness.

Bolt 26 is an elongated bolt of the type known and understood in the relevant art and includes a head 54 at one end and a plurality of external threads 56 formed on the other end thereof. Nut 28 includes a plurality of internal threads 57 that cooperate threadably with external threads 56. In the preferred embodiment, nut 28 is a separate component of post mount 2, but in other embodiments (not shown) nut 28 may be fixedly attached to clamping plate 24 without departing from the spirit of the present invention. Bolt 26 is configured to be slidingly received within center hole 32 and is of sufficient length to extend through support block 16, adjustment plate 18, retention plate 44, bearing plate 22, floor 6, and clamping plate 24, and still extend sufficiently beyond clamping plate 24 to permit nut 28 to be threaded thereon and to permit adjustment plate 18 to be adjusted by adjustment bolts 20 as will be set forth more fully below. Bolt 26 and nut 28 are preferably manufactured of materials suited to withstand the tension that will be experienced by bolt 26 in the present application, as will be set forth more fully below, such as steel or other appropriate materials.

In use, post 4 is connected to floor 6 by installing post mount 2 onto plank 8 and sliding post 4 onto post mount 2 such that support block 16 is slidably received in cavity 13. Post mount 2 is installed on floor 6 by first installing compression pins 30 in pin holes 50. Adjustment bolts 20 are then threaded into threaded holes 41 of adjustment plate 18 until the threaded tips of adjustment bolts 20 protrude slightly from the underside of adjustment plate 18. The threaded tips of adjustment bolts 20 should initially protrude from adjustment plate 18 at least slightly more than the thickness of retention plate 44.

Bolt 26 is then inserted into center hole 32, with the threaded end of bolt 26 then being passed through bolt hole 42 of adjustment plate 18, bolt hole 46 of base molding 14, bolt hole 48 of bearing plate 42, bolt hole 51 of floor 6, and bolt hole 53 of clamping plate 24 such that the aforementioned components are axially aligned about bolt 26. Nut 28 is threaded slightly onto threads 56 of bolt 26 to prevent the aforementioned parts from separating. A level (not shown) is then applied to at least two vertical surfaces of support block 16 to determine whether or not support block 16 is oriented plumb with the vertical direction. Inasmuch as support block 16 is disposed on the upper surface of adjustment plate 18, adjustment of adjustment plate 18 with respect to floor 6 results in a corresponding angular movement of support block 16. In accordance with the features of the present invention, adjustment bolts 20 are each incrementally adjusted until support block 16 is oriented plumb with the vertical direction. Each bolt 20 threadably engages adjustment plate 18 and abuts bearing plate 22 which does not move relative to plank 8. Thus, rotation of bolts 20 causes adjustment plate 18 to move with respect to bearing plate 22. It is understood that support block 16 may be oriented in a non-plumb orientation as needed for a particular application without departing from the spirit of the present invention.

Nut 28 is then tightened on bolt 26 until an appropriate level of tension is achieved in bolt 26. In such condition, support block 16, adjustment plate 18, bearing plate 22, compression pins 30, and clamping plate 24 are compressed between head 54 and nut 28. Support block 16 is compressed against adjustment plate 18, and adjustment bolts 20 carried by adjustment plate 18 are compressed against bearing plate 22. Bearing plate 22 is compressed against both compression pins 30 and plank 8. In this regard, compression pins 30 and plank 8 are compressed between bearing plate 22 and clamping plate 24.

After support block 16 has been oriented to the plumb or non-plumb orientation desired and nut 28 has been tightened onto bolt 26, lips 39 or tabs 40 are biased outward as desired and post 4 is slid onto post mount 2 such that support block 16 is slidingly received in cavity 14. Stringers 11 and balusters 12, or other such structures as are desired are then installed to form fence 10.

As is understood in the relevant art, plank 8, if manufactured of wood, may be incapable of sustaining significant levels of compressive force for extended periods of time. In accordance with the features of the present invention, the positioning of compression pins 30 in substantial axial alignment with adjustment bolts 20 causes a substantial portion of the compressive force of bolt 26 to be carried by compression pins 30. Thus, support block 16 can be tightly compressed against floor 6 without plank 8 being overcompressed thereby and potentially damaged. Further in accordance with the features of the present invention, adjustment bolts 20 permit support block 16 to be aligned plumb with the vertical direction and to maintain the plumb orientation thereof despite the compressive force imparted between bolts 26 and nut 28.

Figure 4:
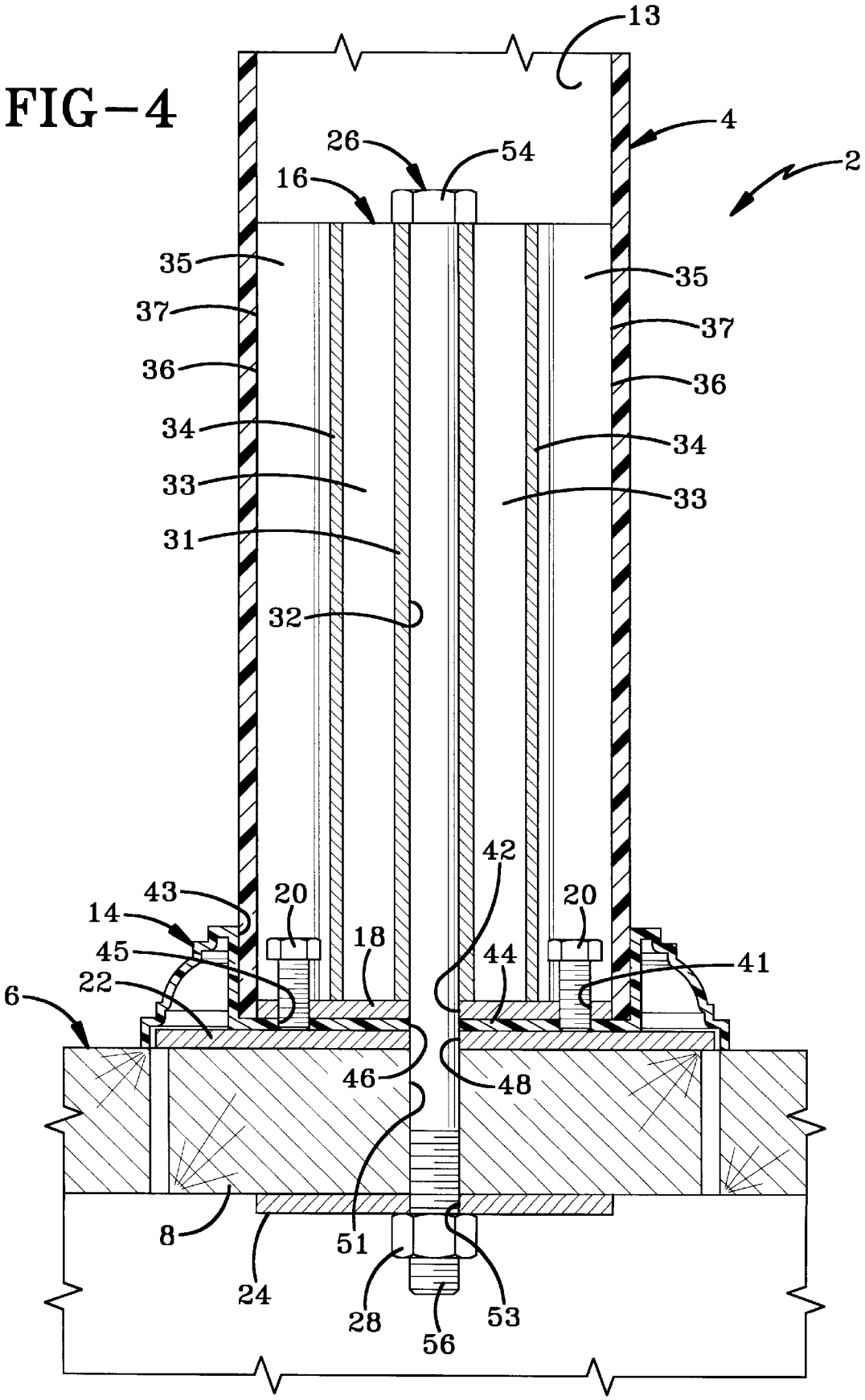
FIG. 4 is a view similar to FIG. 3 depicting an optional configuration of the first embodiment wherein compression pins are not used.

An optional configuration of the first embodiment of the present invention is depicted in FIG. 4 wherein post mount 2 does not include compression pins 30. In this regard, adjustment bolts 20 compress against bearing plate which, in turn, compresses directly against plank 8. The optional configuration shown in FIG. 4 is especially useful in situations where a lesser degree of compression is required to retain support block 16 against floor 6 or where plank 8 is manufactured of materials having qualities enabling it to withstand the compression provided between bolt 26 and nut 28.

Furthermore, and in accordance with the features of the present invention, support block 16 assists post 4 to withstand moderate shock at the lower end thereof inasmuch as support block 16 provides support to the lower end of post 4 by at least partially filling post 4 and providing internal structure that resists shock forces such as kicking. Post mount 2 further supports the lower end of post 4 by connecting it to floor 6.

Figure 5:
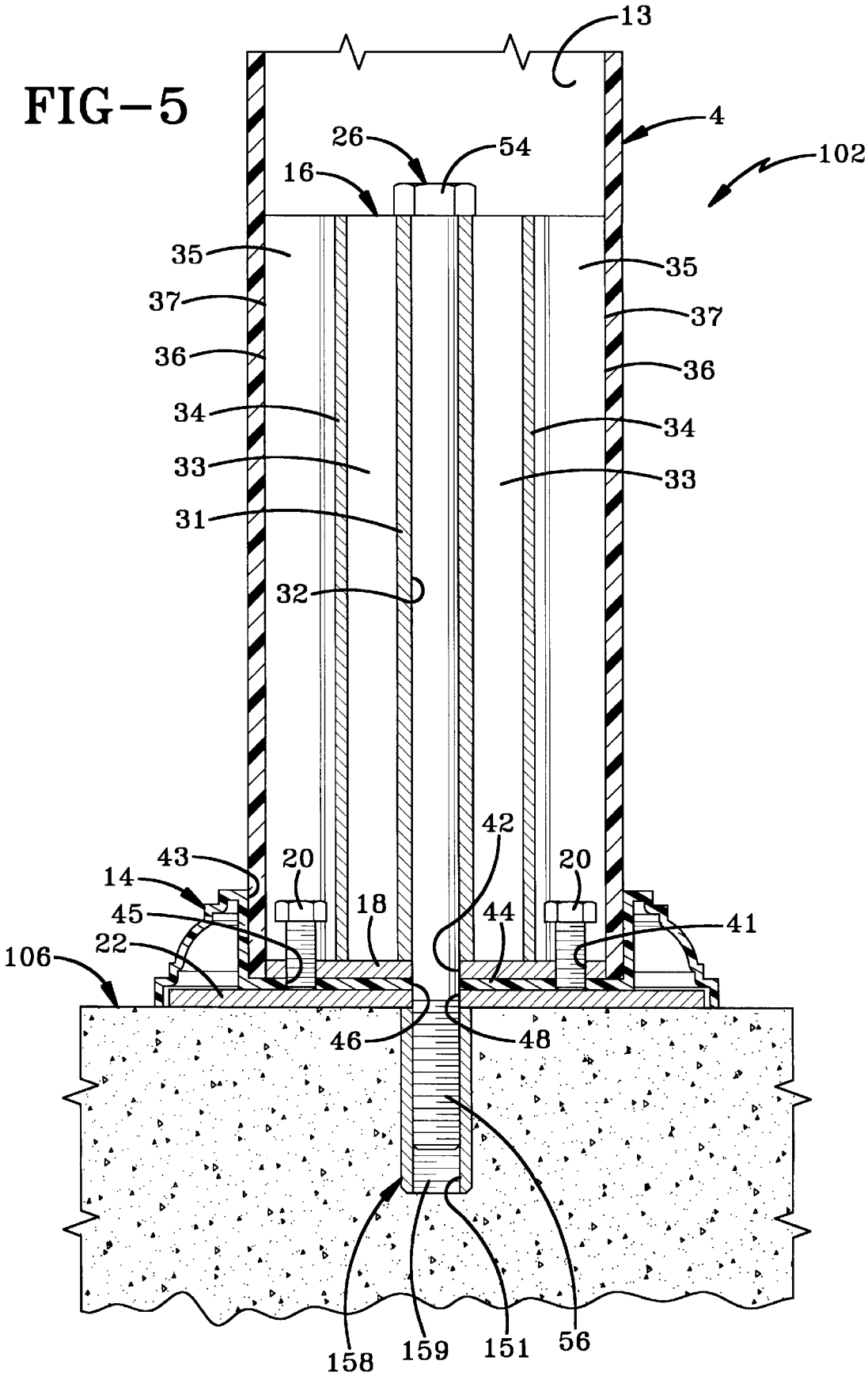
FIG. 5 is a longitudinal sectional view of a second embodiment of the post mount of the present invention.
Figure 6:
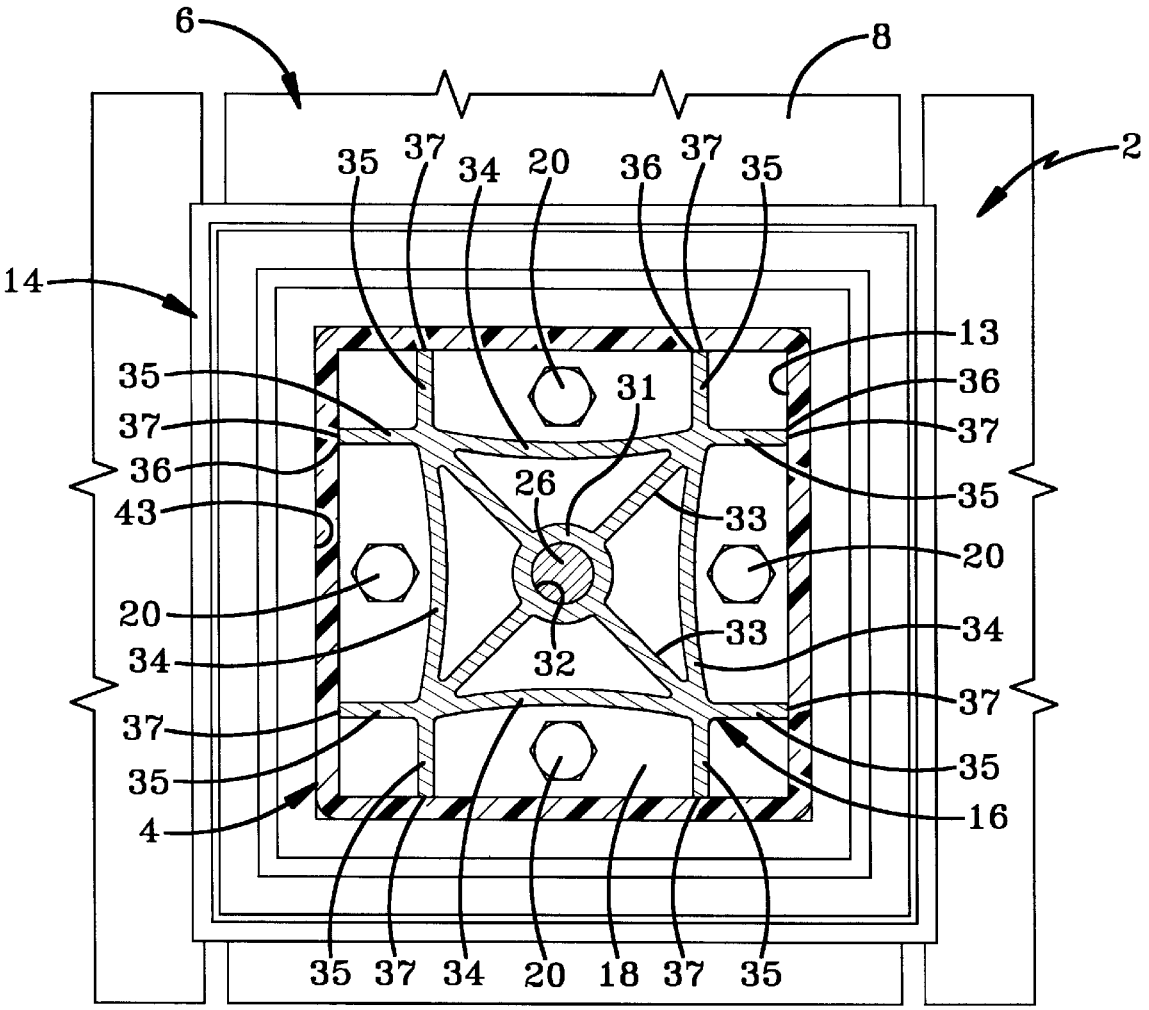
FIG. 6 is a sectional view of the first embodiment as shown along line 6—6 of FIG. 3.

A second embodiment of the present invention is indicated generally by the numeral 102 in FIG. 5. Post mount 102 is substantially similar to post mount 2 except it is used in conjunction with a floor 106 that does not have an exposed underside, such as a concrete floor that is poured against the grade. Floor 106 is formed with a bolt hole 151, and a threaded insert 158 is installed in bolt hole 151 in a manner known in the art that prevents insert 158 from being pulled out of hole 151. Threaded insert 158 contains a plurality of internal threads 159 that cooperate threadably with external threads 56 formed on bolt 26. Adjustment bolts 20 are adjusted until support block 16 is oriented plumb with the vertical direction, and bolt 26 is threaded into threaded insert 158 to hold support block 16 in position.

Figure 7:
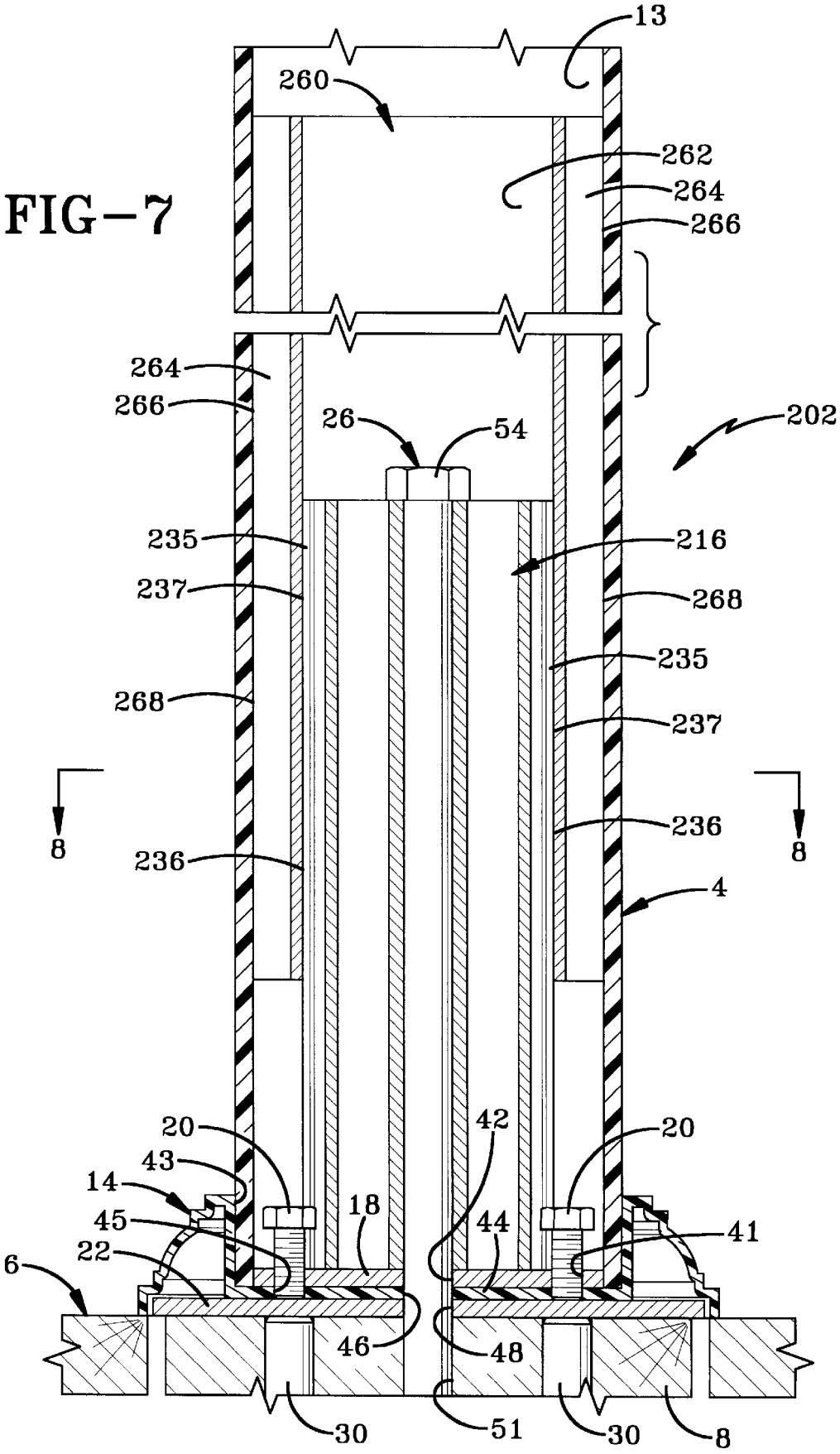
FIG. 7 is a longitudinal sectional view of a third embodiment of the present invention.
Figure 8:
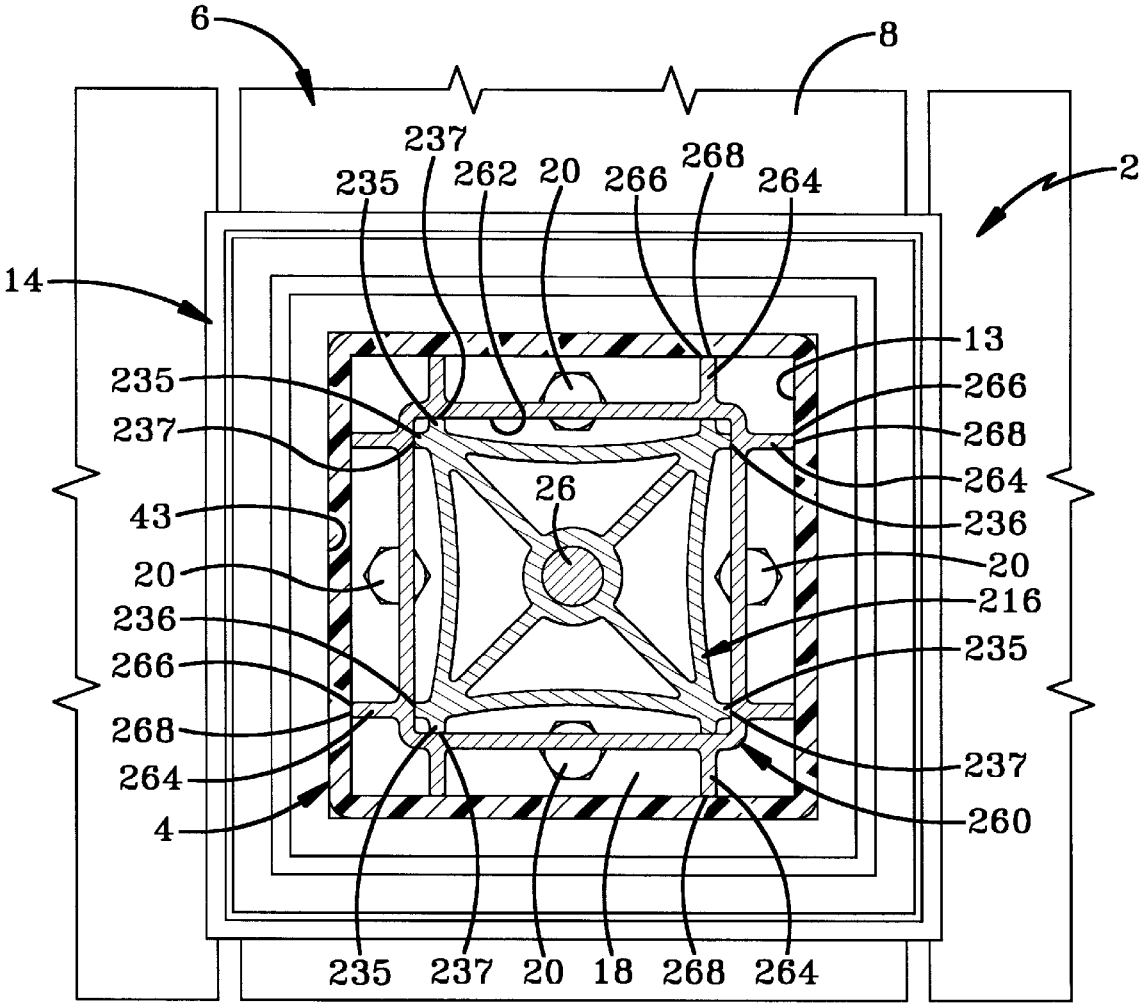
FIG. 8 is a sectional view as shown along line 8—8 of FIG. 7.

A third embodiment of the present invention is indicated generally by the number 202 in FIGS. 7–8. Post mount 202 is similar to post mount 2 and the same numbers are used to represent similar parts. Mount 202 is different in that support block 216 is of a slightly different configuration than support block 16, and post mount 202 additionally includes a sleeve 260 interposed between post 4 and support block 216. As can be seen in FIGS. 7–8, fins 235 of support block 216 are foreshortened as compared with fins 35 of support block 16. Sleeve 260 is a hollow elongated member formed with a through bore 262 and includes a plurality of fingers 264 extending outwardly therefrom. Each finger 264 at an end 266. An outer surface 268 is defined along ends 266. A support surface 237 of support block 216 is slidingly received in through bore 262, and outer surface 268 is slidingly received in cavity 13. Support block 216 and sleeve 260 preferably connect tightly with one another. It is additionally understood that lips 39 and/or tabs 40 may be defined on fingers 264 for operative interaction with cavity 13.

Inasmuch as support block 216 is fastened to floor 6 independently of sleeve 260, it is understood that sleeve 260 can be configured to extend substantially the length of post 6. In accordance with the features of the present invention, therefore, sleeve 260 substantially increases the rigidity of post 6, yet permits a relatively short support block 216 to be fixedly attached to floor 6. While support block 216 potentially may be configured to extend fully the length of post 6, such a configuration would likely be impractical because of cost considerations and due to the fact that an extremely long bolt 26 would be required and the compression induced in an unduly long support block 216 might result in buckling thereof. Thus, support post 202 firmly affixes post 4 to floor 6 in a plumb orientation with the vertical direction and additionally provides structural rigidity along the length of post 6 while helping post 6 to withstand moderate shock impact to the lower end thereof.

Accordingly, the improved post mount apparatus is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the post mount is constructed and used, the characteristics of the construction, and the advantageous new and useful results obtained; the new and useful structures, devices, elements, arrangements, parts, and combinations are set forth in the appended claims.

I claim:

1. In combination:

a floor member;

a post mount mounted on the floor member; and a construction member having a cavity in a first end, the cavity defining the inner surface of the construction member; said post mount being slidably received in said cavity; the post mount having at least one protruding member that frictionally engages the inner surface of the construction member.

2. The combination as set forth in claim 1 wherein said post mount includes a support block and a bolt, said support block having a support surface, said bolt connecting said support block to said floor member.

3. The combination as set forth in claim 2, further comprising an adjustment plate, said adjustment plate interposed between said support block and said floor member.

4. In combination:

a floor member;

a post mount mounted on the floor member;

a construction member having a cavity in a first end, the post mount being slidably received in the cavity;

said post mount including a support block and a bolt, the support block having a support surface, the bolt connecting the support block to the floor member; and an adjustment plate interposed between the support block and the floor member;

the position of said adjustment plate with respect to said floor member being adjustable.

5. The combination as set forth in claim 4, further comprising at least a first adjustment bolt operatively attached to said adjustment plate.

6. The combination as set forth in claim 5 wherein adjustment of said adjustment plate with respect to said floor causes a corresponding movement of said support block with respect to the vertical direction.

7. The combination as set forth in claim 4, further comprising a bearing plate interposed between said floor member and said adjustment plate.

8. The combination as set forth in claim 4 wherein said bolt threadably engages said floor member.

9. The combination as set forth in claim 8 wherein said floor member includes a threaded insert, said bolt threadably engaging said insert.

10. In combination:

a floor member;

a post mount mounted on the floor member;

a construction member having a cavity in a first end, said post mount being slidably received in said cavity;

said post mount including a support block and a bolt, said support block having a support surface, said bolt connecting said support block to said floor member; and a clamping plate, said floor member interposed between said adjustment plate and said clamping plate, said bolt holding said clamping plate and said support block.

11. The combination as set forth in claim 10, further comprising at least a first compression pin interposed between said adjustment plate and said clamping plate.

12. The combination as set forth in claim 11 wherein said floor is formed with at least a first pinhole, said at least first compression pin being disposed within said at least first pinhole.

13. In combination:

a floor member;

a post mount mounted on the floor member;

a construction member having a cavity in a first end, said post mount being slidably received in said cavity;

said post mount including a support block and a bolt, said support block having a support surface, said bolt connecting said support block to said floor member; and said post mount further including a sleeve formed with a through bore, said sleeve having an outer surface, said support surface slidably received in said through bore, said outer surface slidably received in said cavity.

14. The combination as set forth in claim 13, further comprising at least a first finger protruding outwardly from said sleeve and terminating at an end.

15. The combination as set forth in claim 2 wherein said post mount includes at least a first fin protruding outwardly from said support block and terminating at a tip.

16. In combination:

a floor member;

a post mount mounted on the floor member;

a construction member having a cavity in a first end, said post mount being slidably received in said cavity;

said post mount including at least a first fin protruding outwardly from said support block and terminating at a tip; and at least a first deflection member formed on said support block.

17. A post mount for supporting a construction member on a surface, the construction member formed with a cavity in a first end, the post mount comprising:

a support block having a support surface, said support surface configured to be slidingly received in the cavity;

a bolt passing through at least a portion of said support block, said bolt adapted to be engagable with the surface to connect said support block to the surface;

an adjustment plate defining at least one threaded hole;

said adjustment plate adapted to be interposed between said support block and the surface; and an adjustment bolt threadedly disposed within the at least one threaded hole in the adjustment plate; the adjustment bolt adapted to alter the position of the adjustment plate with respect to the surface by engaging the surface and moving at least a portion of the adjustment plate away from the surface.

18. The post mount as set forth in claim 17, further comprising a bearing plate, said adjustment plate interposed between said bearing plate and said support block.

19. The post mount as set forth in claim 18, wherein said bolt passes through each of said adjustment plate and said bearing plate.

20. The post mount as set forth in claim 18, further comprising a clamping plate and a nut, said bearing plate being interposed between said clamping plate and said adjustment plate.

21. A post mount for supporting a construction member on a surface, the construction member formed with a cavity in a first end, the post mount comprising:

a support block having a support surface, said support surface configured to be slidingly received in the cavity;

a bolt passing through at least a portion of said support block, said bolt adapted to be engagable with the surface to connect said support block to the surface; and a sleeve formed with a through bore, said support block slidingly received in said through bore, said sleeve adapted to be slidingly received in the cavity of the construction member.

22. A post mount for supporting a construction member on a surface, the construction member formed with a cavity in a first end, the post mount comprising:

a support block having a support surface, said support surface configured to be slidingly received in the cavity;

a bolt passing through at least a portion of said support block, said bolt adapted to be engagable with the surface to connect said support block to the surface; and at least a first fin extending outwardly from said support block, each fin terminating at a tip.

23. A post mount for supporting a construction member on a surface, the construction member formed with a cavity in a first end, the post mount comprising:

a support block having a support surface, said support surface configured to be slidingly received in the cavity;

a bolt passing through at least a portion of said support block, said bolt adapted to be engagable with the surface to connect said support block to the surface; and said support bock including a center lug and at least three first webs extending out from said center lug.

24. The post mount as set forth in claim 23, further comprising a plurality of second webs interconnecting said first webs.

25. The post mount as set forth in claim 24, further comprising a plurality of fins extending out from said second webs.

26. The post mount as set forth in claim 25, wherein said center lug has a center hole disposed therein; said bolt being slidingly received in said center hole.

27. The post mount as set forth in claim 26, wherein each of said first webs is radially disposed with respect to said center hole.

28. The post mount as set forth in claim 27, where each of said second webs is substantially perpendicular to the other of said second webs.

29. The combination of claim 16, wherein the deflection member is a protruding, cantilevered lip defined by a notch formed in the support block.

30. The combination of claim 16, wherein the deflection member is a protruding tab.

31. A post mount for supporting a construction member on a surface, the construction member formed with a cavity in a first end, the post mount comprising:

a support block having a support surface, said support surface configured to be slidingly received in the cavity;

a bolt passing through at least a portion of said support block, said bolt adapted to be engagable with the surface to connect said support block to the surface;

at least a first deflection member formed on said support block, the deflection member adapted to engage the construction member.

32. The post mount of claim 31, wherein the support block includes an outer edge;

the deflection member being formed adjacent the outer edge.

33. The post mount of claim 32, wherein the deflection member is a protruding, cantilevered lip.

34. The post mount of claim 32, wherein the deflection member is a protruding tab.

35. The post mount of claim 32, wherein the support block includes at least one fin, the deflection member being formed in the fin.

* * * * *